US007346296B2

(12) United States Patent
Lee et al.

(10) Patent No.: US 7,346,296 B2
(45) **Date of Patent: *Mar. 18, 2008**

(54) ROTATING MEMBER FOR GENERATING AIR CURRENT IN A DEVELOPING DEVICE AND IMAGE FORMING APPARATUS HAVING THE SAME

(75) Inventors: Su-in Lee, Seongnam-si (KR); Ji-won Moon, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/327,489

(22) Filed: Jan. 9, 2006

(65) Prior Publication Data

US 2006/0153593 A1 Jul. 13, 2006

(30) Foreign Application Priority Data

Jan. 12, 2005 (KR) ..... 10-2005-0002773

(51) Int. Cl.
*G03G 15/00* (2006.01)

(52) U.S. Cl. ..... 399/167; 399/262; 399/343; 399/359

(58) Field of Classification Search ..... 399/359, 399/262, 120, 98, 343, 167, 92
See application file for complete search history.

(56) References Cited

U.S. PATENT DOCUMENTS 4,361,396 A * 11/1982 Uchida ..... 399/92
5,724,634 A * 3/1998 Maruta ..... 399/227
5,923,922 A * 7/1999 Ishida et al. ..... 399/98
2001/0010767 A1* 8/2001 Watanabe ..... 399/92
2001/0017994 A1* 8/2001 Arimitsu et al. ..... 399/167
2004/0052545 A1* 3/2004 Satoh ..... 399/92
2005/0095028 A1* 5/2005 Lee et al. ..... 399/98

FOREIGN PATENT DOCUMENTS

JP 58011969 A * 1/1983
JP 59170868 A * 9/1984
JP 59220773 A * 12/1984
JP 60133478 A * 7/1985
JP 60-229064 11/1985
JP 61-032877 2/1986
JP 01038776 A * 2/1989
JP 03-107185 5/1991
JP 04-258954 9/1992
JP 06011970 A * 1/1994

(Continued)

*Primary Examiner*—David M. Gray
*Assistant Examiner*—Geoffrey T. Evans
(74) *Attorney, Agent, or Firm*—Roylance, Abrams, Berdo & Goodman, L.L.P.

(57) ABSTRACT

A developing device of an image forming apparatus has an image carrier rotating in confrontation with a developer conveyer and developing the surface of the image carrier with a developer moved by the developer conveyer. A rotating member is rotatably formed adjacent to the image carrier and generates an opposite air current to an air current generated as the image carrier and the developer conveyer are rotated. A power transmission unit transmits power of the image carrier to the rotating member.

20 Claims, 6 Drawing Sheets

FOREIGN PATENT DOCUMENTS

| | | | | |
|---|---|---|---|---|
| JP | 06-282208 | | | 9/1994 |
| JP | 06289697 | A | * | 10/1994 |
| JP | 10003220 | A | * | 1/1998 |
| JP | 11095551 | A | * | 4/1999 |
| JP | 11231652 | A | * | 8/1999 |
| JP | 2002278388 | A | * | 9/2002 |

* cited by examiner

ROTATING MEMBER FOR GENERATING AIR CURRENT IN A DEVELOPING DEVICE AND IMAGE FORMING APPARATUS HAVING THE SAME

CROSS-REFERENCE TO RELATED APPLICATIONS

This application claims the benefit under 35 U.S.C. § 119 (a) of Korean Patent Application No. 2005-2773, filed on Jan. 12, 2005, the entire contents of which are hereby incorporated by reference.

BACKGROUND OF THE INVENTION

1. Field of the Invention

The present invention relates to a developing device and an image forming apparatus.

2. Description of the Related Art

Generally, an image forming apparatus, such as a laser printer, an LED printer, a digital copier, or a general paper facsimile, transfers and prints an image signal according to an input digital signal on a printing medium, that is, a paper, in a visible image form.

The image forming apparatus includes a developing device, a laser-scanning device, and a fixing device.

The developing device includes an image carrier, such as a photosensitive drum, developing a visible image, and a developing member transferring a developer, such as toner, to the image carrier.

An electrostatic latent image is formed at the surface of the image carrier corresponding to the visible image by light emitted from the laser-scanning device.

As an example of the developing member, a developing roller according to a contactless developing method rotates with a developing gap against the image carrier. The developing roller transfers a developer, such as toner, to the electrostatic latent image area according to the contactless developing method. The developer attached to the developing roller is attracted to the electrostatic latent image area via the developing gap by a static electricity according to a difference of electric potential between the electrostatic latent image and the developing roller. The toner attracted to the electrostatic latent image is transferred to a printing medium passing through the image carrier and the developing roller. The printing medium passes the fixing device, and the visible image transferred to the printing medium is adhered to the printing medium by a high temperature and pressure.

As the image carrier and the developing roller rotate in a forward direction, which is a direction of rotating in mesh with each other, a regular airflow is generated in the developing gap. An airflow also is generated between the printing medium and the developing device by the movement of the printing medium.

The toner particles moved from the developing roller to the electrostatic latent image via the developing gap is disturbed by the airflow, and the insufficiently-charged toner particles may not be attracted to the electrostatic latent image due to the effect of the airflow rather than adhering due to static electricity.

Additionally, toner particles may be scattered into the image forming apparatus by the airflow, thereby contaminating the inside of the device.

Accordingly, a need exists for an image forming apparatus having an improved developing device that substantially prevents developer from scattering.

SUMMARY OF THE INVENTION

An aspect of the present invention is to provide a developing device improved in restraining a scatter of a developer and an image forming apparatus having the same.

A developing device of an image forming apparatus includes an image carrier rotating in confrontation with a developer conveyer and developing the surface of the image carrier with a developer moved by the developer conveyer. A rotating member is rotatably formed adjacent to the image carrier and generates an opposite air current to an air current that is generated as the image carrier and the developer conveyer are rotated. A power transmission unit transmits power of the image carrier to the rotating member.

The power transmission unit includes a driving gear formed at an end of the image carrier and a driven gear formed at an end of the rotating member that receives power from the driving gear.

The power transmission unit may further include a plurality of idle gears connecting the driving gear and the driven gear.

The image carrier may include at the other end a main gear for receiving power from a power source.

The developing device may further include a developing device body housing therein the image carrier and the developer conveyer. The housing is engaged with a lower portion of the developing device body and has the rotating member rotatably formed therein.

The housing may have a place for receiving scattered developer that is moved by the air current generated by the rotation of the rotating member.

The housing may be detachably engaged with the developing device body.

The power transmission unit may further include one or more idle gears transmitting the power of the driving gear to the driven gear.

The idle gear may be rotatably formed in the developing device body.

The idle gear may be rotatably formed in the housing.

The driving gear may be connected with a gear of a transfer roller that is rotated in mesh with the image carrier to transfer an image to a printing medium.

An image forming apparatus includes an image forming apparatus body having a transfer roller therein. A developing unit is detachably installed in the body and has an image carrier and a developer conveyer. A rotating member is rotatably formed adjacent to the image carrier and generates an opposite air current to an air current generated as the image carrier and the developer conveyer are rotated. A driving part drives the image carrier and the developer conveyer. A power transmission unit transmits power of the image carrier to the rotating member.

The power transmission unit may include a driving gear formed at an end of the image carrier and a driven gear formed at an end of the rotating member that receives power from the driving gear.

The power transmission unit may further include one or more idle gears formed between the driving gear and the rotating member.

The driving part may further include one or more driving motors formed in the body and a main gear formed at the other end of the image carrier that receives power from one of the driving motors.

The power transmission unit may include a driving gear formed at the other end of the image carrier and a driven gear formed at the other end of the rotating member that engages the driving gear.

The power transmission unit may further include one or more idle gears connecting the driving gear and the driven gear.

The transfer roller may be engaged with the driving gear to receive power for rotating.

The driving motors may include a first driving motor providing the image carrier with power and a second driving motor providing the developer conveyer with power independently from the first driving motor.

The image forming apparatus may further include a housing for receiving scattered developer that is moved by an air current generated by the rotation of the rotating member.

The housing may rotatably support the rotating member and be detachably engaged with the developing unit.

The housing may include an idle gear for transmitting power from the image carrier to the rotating member.

Other objects, advantages and salient features of the present invention will become apparent from the following detailed description, which, taken in conjunction with the annexed drawings, discloses exemplary embodiments of the present invention.

BRIEF DESCRIPTION OF THE DRAWINGS

The above and other aspects, features and advantages of the exemplary embodiments of the present invention will be more apparent from the following detailed description taken with reference to the accompanying drawings, in which.

Throughout the drawings, like reference numerals will be understood to refer to like parts, components and structures.

DETAILED DESCRIPTION OF EXEMPLARY EMBODIMENTS

Exemplary embodiments of the present invention are described in detail with reference to the annexed drawings. In the following description, detailed descriptions of known functions and configurations incorporated herein are omitted for conciseness and clarity.

Figure 1:
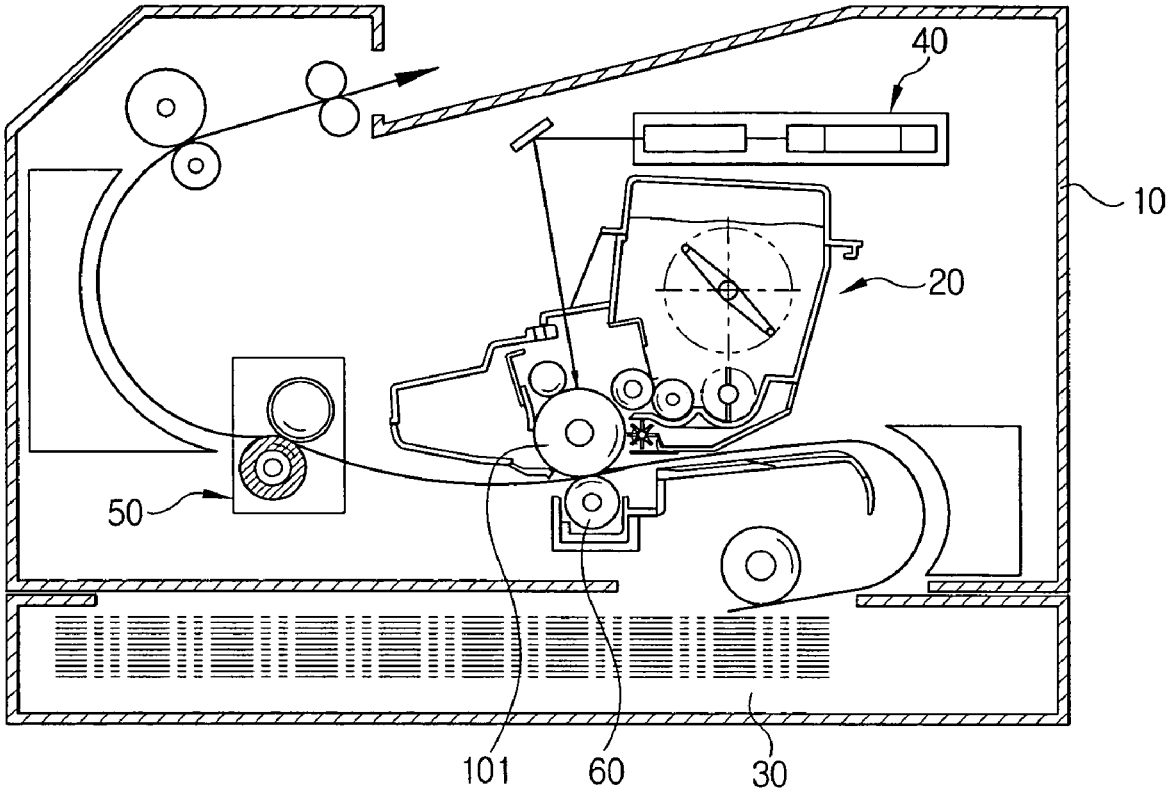
FIG. 1 is a schematic diagram of an image forming apparatus according to an exemplary embodiment of the present invention.

FIG. 1 is a schematic diagram of an image forming apparatus according to an exemplary embodiment of the present invention.

Referring to FIG. 1, an image forming apparatus includes a developing device 20 installed in a body 10. A feeding unit 30 supplies the developing device 20 with a printing medium. A laser scanning unit 40 and a fixing unit 50 are also disposed in the body 10.

The laser scanning unit 40 scans a light to an image carrier 101 of the developing device 20 to form an electrostatic latent image corresponding to a desirable image.

The fixing unit 50 fixes with a high temperature and pressure the image transferred to the printing medium when the printing medium passed through the developing device 20. The laser scanning unit 40 and the fixing unit 50 are well-known in the art, and therefore, a detailed description thereof is omitted.

A transfer roller 60 rotates in contact with the image carrier 101. The image formed on the image carrier 101 is transferred to the printing medium passing between the image carrier 101 and the transfer roller 60.

Figure 2:
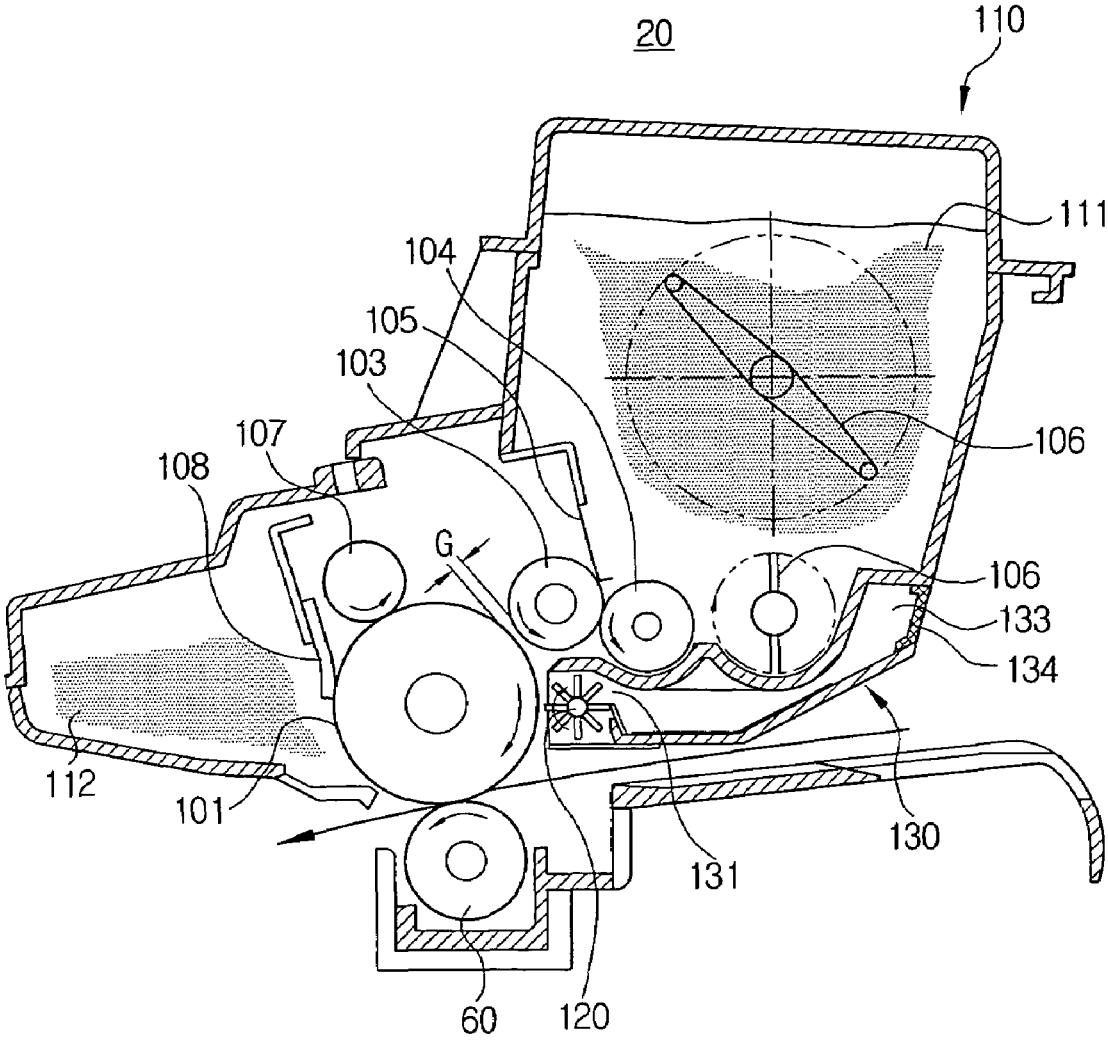
FIG. 2 is an elevational view in partial cross section of a developing device of FIG. 1.

The developing device 20 includes a developing device body 110, a rotating member 120, and a housing 130, as shown in FIG. 2.

The developing device body 110 includes therein a new toner supply chamber 111 receiving new developer, that is new toner, and a waste toner receiving chamber 112 receiving waste developer.

The developing device body 110 has therein the image carrier 101 and a developer conveyer 103 that rotates with a certain gap G therebetween. The developer conveyer 103 is rotatably driven in the new toner supply chamber 111 to supply the image carrier 101 with a developer. An exemplary embodiment is explained with the developer having a single-ingredient, such as a nonmagnetic developer using a polyester resin as a binder resin.

The developer conveyer 103 may be a conductive rubber roller or a cylindrical aluminum metal roller. The metal roller may be sandblasted and plated with a nickel (Ni).

The developing device body 110 further includes therein a supply roller 104 supplying the developer conveyer 103 with a developer. A developer layer control member 105 controls the developer layer of a surface of the developer conveyer 103 as a substantially regular thickness. The control member 105 is made of an elastic stainless sheet, and an end of the control member 105 is fixed in the developing device body 110 to contact the developer conveyer 103. The supply roller 104 rotates in the same direction as the developer conveyer 103, and supplies the developer between the developer conveyer 103 and the control member 105.

The developer conveyer 103, the supply roller 104, and the control member 105 are repeatedly supplied with an alternating current (AC) voltage and a direct current (DC) voltage from a power supply part (not shown). The features, such as a peak to peak voltage (Vpp), a frequency, and a duty ratio, of the voltage supplied from the power supply part, may be appropriately controlled by usage circumstances and various printing conditions.

An agitator 106 is rotatably provided in the new toner supply chamber 111 to agitate the developer.

The image carrier 101 faces the developer conveyer 103 and rotates in a forward direction with the developer conveyer 103. A linear velocity of the image carrier 101 may be smaller than that of the developer conveyer 103. The developer on the surface of the developer conveyer 103 is attracted to the electrostatic latent image area of the image carrier 101 by a so-called jumping developing method. The developing gap G may be retained as appropriate from approximately 0.3 mm to 0.4 mm.

The developing device body 110 further includes therein an electric charge member 107 that charges the surface of the image carrier 101 and a cleaning member 108 that cleans the surface of the image carrier 101.

Figure 3:
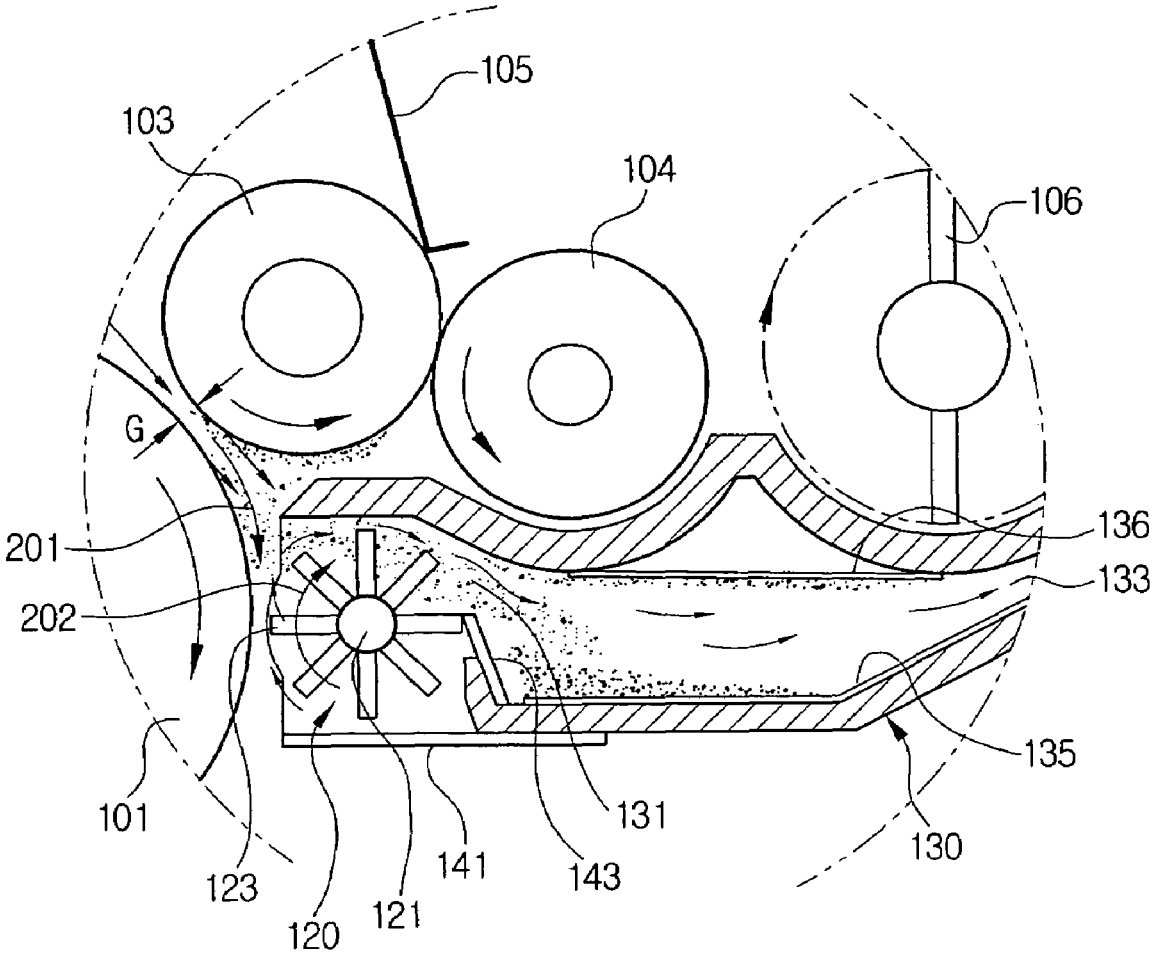
FIG. 3 is an enlarged elevational view of a rotating member of the developing device of FIG. 2.
Figure 4:
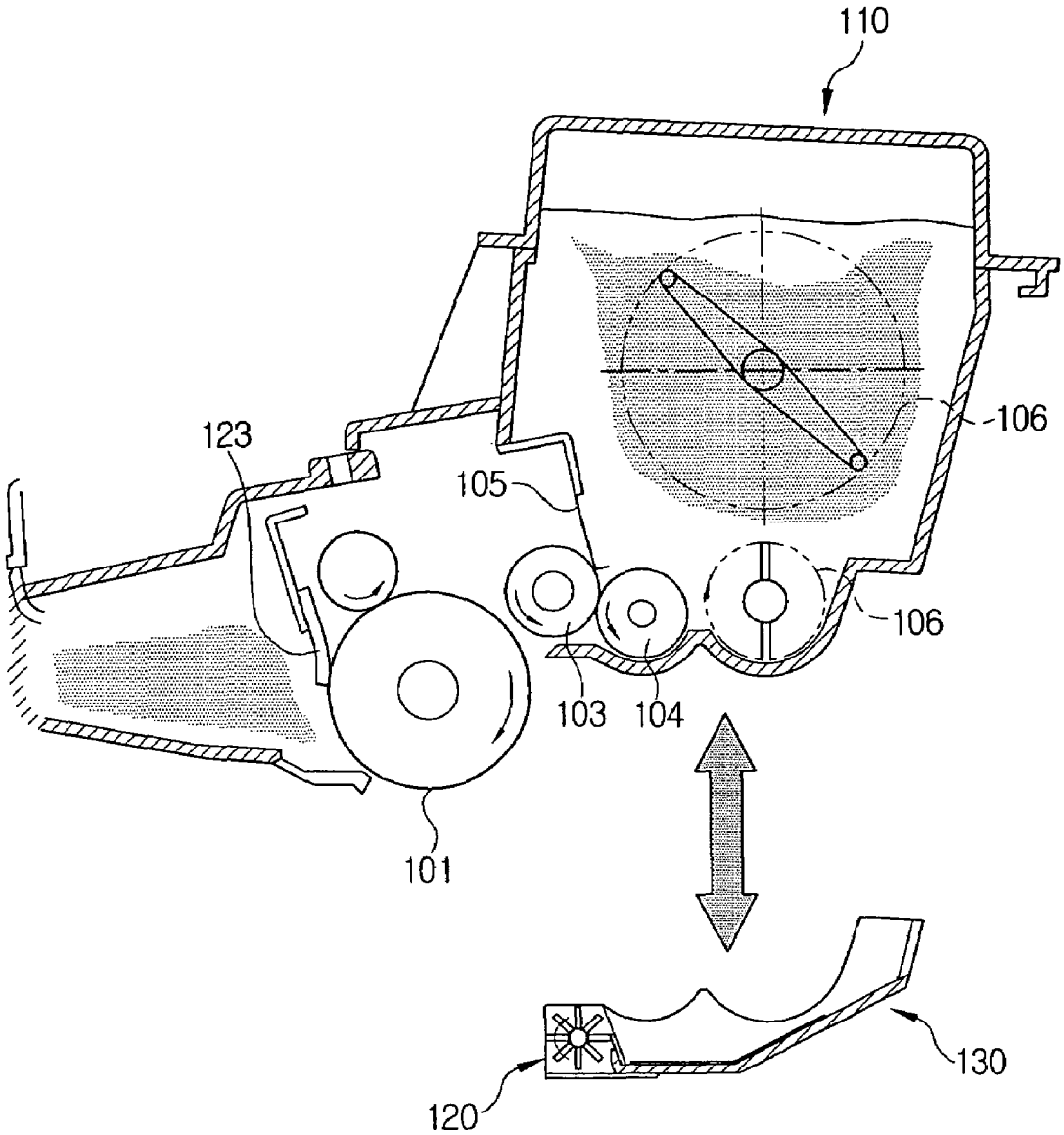
FIG. 4 is an elevational view of a separated state of the developing device of FIG. 2.

The rotating member 120 restrains the scattering of developer by the airflow generated in the developing gap G as the image carrier 101 and the developer conveyer 103 rotate. When printing, the image carrier 101 and the developer conveyer 103 rotate in a forward direction with a certain velocity, and accordingly, an air stream 201 is formed that flows in a forward direction in the developing gap G, as shown in FIG. 3. The rotating member 120 rotates in an opposite direction to the image carrier 101 and generates an air current 202 that flows substantially oppositely to the air current 201.

The rotating member 120 includes a shaft 121, and a plurality of wings 123 radially arranged from an outer circumference of the shaft 121. The shaft 121 and the wings 123 may be integrally formed of a plastic material.

The rotating member 120 is provided at a lower portion of the developing device body 110 to rotate in confrontation with the image carrier 101, such that the rotating member 120 and image carrier 101 are disposed proximal one another in a face-to-face relationship. The rotating member 120 may be formed with a gap within a certain distance, that is preferably about 3 mm, from the image carrier 101. As such, the rotating member 120 minimizes the scattered developer that leaks out between the image carrier 101 and the rotating member 120.

The rotating member 120 rotates in an opposite direction of the image carrier 101 and is rotatably driven by power transmitted from the image carrier 101.

Referring to FIG. 3, the rotating member 120 is rotatably supported by a housing 130 provided at a lower portion of the developing device body 110.

The housing 130 may be integrally formed with the developing device body 110. As shown, the housing 130 may be detachably attached to a lower portion of the developing device body 110. A hook (not shown) or a screw (not shown) may be used to attach the housing 130. The housing 130 receives therein the scattered developer moving according to the air currents 201 and 202, as shown in FIG. 3. The scattered developer returned in the housing 130 may be replaced when the developing device 20 is replaced. Alternatively, the scattered developer may be removed from the housing 130 separately from the developing device 20.

The housing 130 includes an inlet 131 drawing in air and an outlet 133 discharging air when the housing 130 is engaged with the developing device body 110, as shown in FIGS. 2 and 3. The rotating member 120 is formed adjacent to the inlet 131. The scattered developer drawn in via the inlet 131 flows into and is accumulated in the housing 130. The air flows out via the outlet 133. A filter 134 may be further provided at the outlet 133 to substantially prevent developer from flowing out the outlet 133.

Sticky members 135 and 136 may be provided at a bottom and a top within the housing 130 to substantially prevent the scattered developer flowing into the housing 130 from blowing.

A plate member 141 is further formed at a lower portion of the rotating member 120. The plate member 141 is made of an elastically transformable film material and is formed at a lower portion of the inlet 131 side of the housing 130. The gap between the plate member 141 and the rotating member 120 may be from approximately 0 to 3 mm. As such, the developer that has not entered the inlet 131 and drawn by the rotating member 120 into the rotating air current may be effectively included in the air current 202. The plate member 141 may be integrally formed with the housing 130. Preferably, the plate member 141 of the elastic film material may be attached to the housing 130 by an adhesive.

Another film member 143 may be formed at the inlet 131 of the housing 130. The film member 143 minimizes the gap between the inlet 131 and the rotating member 120 and may be provided by attaching an elastically transformable film of a resin system to the housing 130.

Figure 5:
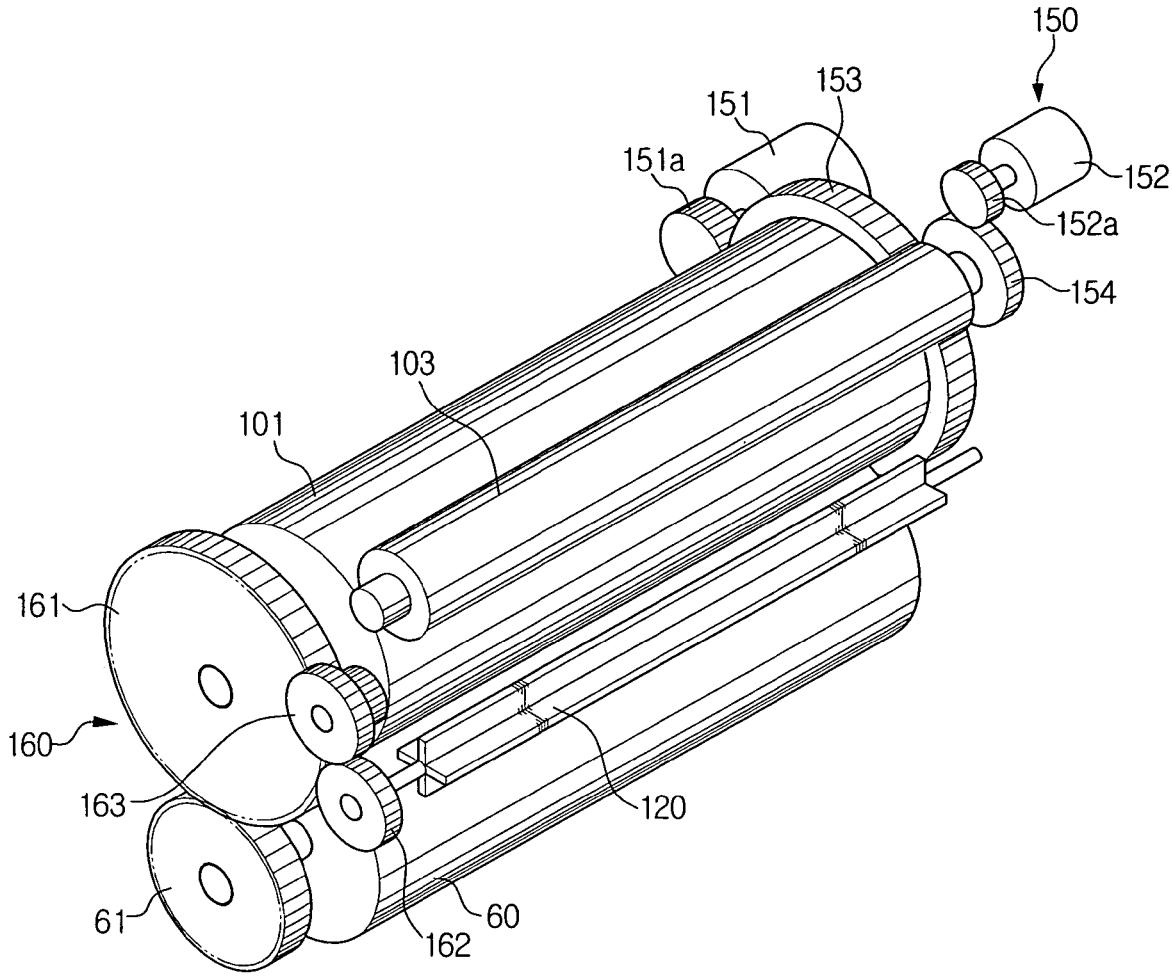
FIG. 5 is a perspective view of an of the driving part and power transmission unit of the developing device of FIG. 2.
Figure 6:
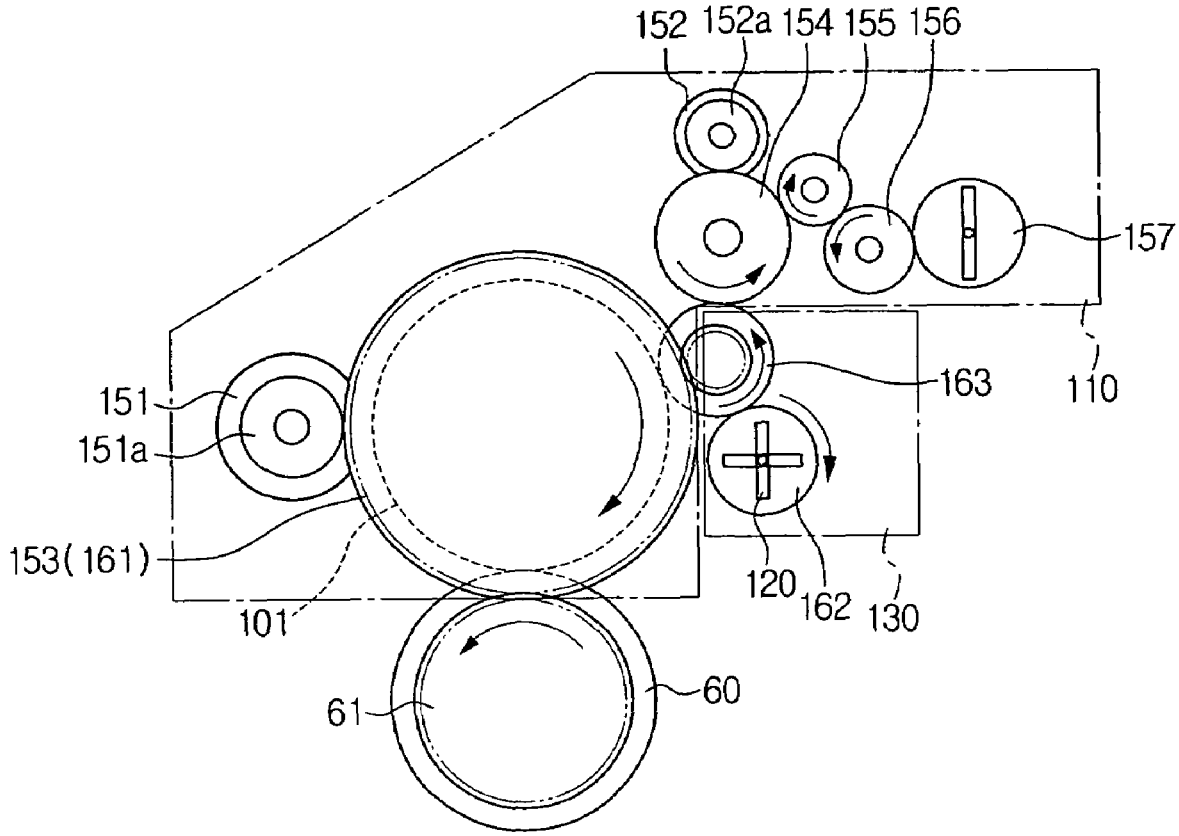
FIG. 6 is a schematic diagram of developing device of FIG. 2 illustrating the driving operation.

As shown in FIGS. 5 and 6, a driving part 150 drives the image carrier 101 and the developer conveyer 103 and a power transmission unit 160 transmits power of the image carrier 101 to the rotating member 120.

The driving part 150 includes first and second driving motors 151 and 152, a main gear 153 coaxially engaged with the image carrier 101, and a developing gear 154 coaxially engaged with the developer conveyer 103.

The first driving motor 151 drives the image carrier 101, and a shaft gear 151*a* connected to a driving shaft engages the main gear 153. The main gear 153 is formed at one side of the image carrier 101.

The second driving motor 152 provides power for driving the developer conveyer 103. The shaft gear 152*a* connected to the driving shaft of the second driving motor 152 engages the driving gear 154. The developing gear 154 transmits power via an idle gear 155 to a supply roller gear 156 and an agitator gear 157, as shown in FIG. 6.

The first and the second driving motors 151 and 152 are formed in the image forming apparatus body to be engaged with the gears 153 and 154 when the developing device 20 is installed therein.

The power transmission unit 160 includes a driving gear 161 at an end of the image carrier 103, a driven gear 162 engaged with an end of the rotating member 120 to receive power from the driving gear 161, and an idle gear 163 connecting the driving gear 161 and the driven gear 162.

The driving gear 161 is formed at an opposite end to the main gear 153 to transmit power to the driven gear 162. Each of gears formed at both ends of the image carrier 101 may prevent torque from being concentrated on the main gear 153 of the image carrier 101. Therefore, the image carrier 101 may be stably rotated, and the developing gap G between the image carrier 101 and the developer conveyer 103 may be retained substantially constant. A transfer gear 61 of the transfer roller 60 engages the driving gear 161 so that the driving force of the transfer roller 60 may be transmitted via the driving gear 61. The gears are arranged such that the transfer gear 61 engages the driving gear 161. Therefore, the gears are not predominantly arranged at one side of the image carrier 101 so that the product size may be controlled.

The idle gear 163 is provided with an odd number of teeth and connects the driven gear 162 and the driving gear 161. If the driving gear 161 is a helical gear or a spiral gear, the idle gear 163 may be provided with 2n−1 (n=natural number) teeth.

The driving gear 161 is installed with the image carrier 101 in the developing device body 110. The driven gear 162 and the idle gear 163 may be installed in the housing 130. Accordingly, the idle gear 163 and the driving gear 161 may be engaged when the housing 130 is installed in the developing device body 110.

The idle gear 163 may be installed in the developing device body 110 to engage the driving gear 161. The idle gear 163 engages the driven gear 162 when the housing 130 is engaged with the developing device body 110.

According to the above structure of an exemplary embodiment, the rotating member 120 receives power from the first driving motor 151. As such, the rotating member 120 rotates and stops in the same pattern with the image carrier 101. The rotating member 120 rotates in a separate way from the developer conveyer 103. The rotating member 120 may be rotated longer than the developer conveyer 103 if the driving motors 151 and 152 are appropriately controlled when printing. Accordingly, the developer scattered by the rotation of the developer conveyer 103 may be minimized.

Hereinafter, the operation of the image forming apparatus with the above structure according to an exemplary embodiment of the present invention is explained.

Referring to FIG. 1, the feeding unit 30 picks up a printing medium to convey the printing medium to the developing device 20. The laser scanning unit 40 scans light to the image carrier 101 to form a certain electrostatic latent image according to the input print data.

As shown in FIG. 2, the developer conveyer 103 rotating with the image carrier 101 is rotated in a forward direction with respect to the rotating direction of the image carrier 101 to move the developer to the electrostatic latent image area of the image carrier 101. At this time, AC voltage and DC voltage are repeatedly supplied to the developer conveyer 103, the supply roller 104, and the control member 105. Accordingly, the developer is attracted to the electrostatic latent image area of the image carrier 101 in the developing gap G between the image carrier 101 and the developer conveyer 103 by the difference between the electric potential of the electrostatic latent image area and static electricity of the developer conveyer 103.

As shown in FIG. 3, the air current 201 is generated in a forward direction in the developing gap G as the image carrier 101 and the developer conveyer 103 rotate. Some developer may be disturbed by the air current 201. The disturbed developer and the developer with weakened electricity flow downstream of the developing gap G by the air current 201.

The rotating member 120 generates the opposite air current 202 to the air current 201 by rotating in an opposite direction of the image carrier 101. The air current 202 removes the developer moving along the air current 201 to the developing gap G The scattered developer flows and returns to the housing 130 as the rotating member 120 rotates. Accordingly, the scattered developer that contaminates the inside of the developing device or the image forming apparatus is minimized.

The developing device 20 and the image forming apparatus with the same include the rotating member 120 generating the opposite air current to the air current generated in the developing gap G to substantially prevent the scattering of the developer.

The scattered developer is collected and stored in a separate collecting area to substantially prevent the scattered developer from contaminating the inside of the image forming apparatus.

The scattered developer may be prevented from contaminating the printing medium, the laser scanning unit 40, and the driving gear 154 and 161 so that the quality of the printed image may be improved.

It is also convenient for a user to manage the developing device since the collected scattered developer is stored in the developing device and the may also be disposed of when the developing device is replaced due to consumed life span.

The rotating member 120 for preventing the developer from scattering is rotated by the driving gears 154 and 161 of the image carrier 101 so that power transmission is improved. The driving gears 154 and 161 and the main gear 153 are arranged such that torque may be distributed to each of both ends of the image carrier 101. Therefore, the rotation driving of the image carrier 101 may be stable, and the developing gap G between the developer conveyer 103 and the image carrier 101 may be regularly maintained.

The rotating member 120 is driven by a separate power source from the developer conveyer 103 to be rotated longer than the developer conveyer 103. Accordingly, the developer may be more effectively prevented from scattering.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developing device of an image forming apparatus, comprising:

an image carrier rotating proximal a developer conveyer and developing the surface with developer moved by the developer conveyer;

a developing device body housing the image carrier and the developer conveyor;

a rotating member rotatably formed adjacent to the image carrier and generating a first air current flowing substantially oppositely to a second air current generated as the image carrier and the developer conveyer are rotated, the rotating member being rotatably disposed in a housing detachably engaged with the developing device body; and a power transmission unit transmitting power of the image carrier to the rotating member.

2. The developing device according to claim 1, wherein the power transmission unit includes a driving gear formed at an end of the image carrier;

a driven gear formed at an end of the rotating member to receive power from the driving gear.

3. The developing device according to claim 2, wherein the power transmission unit includes a plurality of idle gears connecting the driving gear and the driven gear.

4. The developing device according to claim 2, wherein a main gear for receiving power from a power source is disposed at another end of the image carrier.

5. The developing device according to claim 2, wherein the housing is engaged with a lower portion of the developing device body.

6. The developing device according to claim 5, wherein the housing has an area for receiving scattered developer that is brought within the housing by the air current generated by rotation of the rotating member.

7. The developing device according to claim 2, wherein the power transmission unit has one or more idle gears transmitting the power of the driving gear to the driven gear.

8. The developing device according to claim 7, wherein the idle gear is rotatably disposed in the developing device body.

9. The developing device according to claim 7, wherein the idle gear is rotatably disposed in the housing.

10. The developing device according to claim 2, wherein the driving gear is connected to a gear of a transfer roller that is rotated with the image carrier to transfer an image to a printing medium.

11. An image forming apparatus, comprising:

an image forming apparatus body having a transfer roller therein;

a developing unit detachably installed in the body and having an image carrier and a developer conveyer disposed therein;

a rotating member rotatably formed adjacent to the image carrier and generating a first air current that flows substantially oppositely to a second air current generated as the image carrier and the developer conveyer are rotated, the rotating member being rotatably disposed in a housing detachably engaged with the developing unit;

a driving part for driving the image carrier and the developer conveyer; and a power transmission unit for transmitting power of the image carrier to the rotating member.

12. The image forming apparatus according to claim 11, wherein the power transmission unit includes a driving gear formed at an end of the image carrier;

a driven gear formed at an end of the rotating member to receive power from the driving gear.

13. The image forming apparatus according to claim 12, wherein the power transmission unit includes one or more idle gears disposed between the driving gear and the rotating member.

14. The image forming apparatus according to claim 11, wherein the driving part includes one or more driving motors disposed in the body; and a main gear formed at another end of the image carrier and receiving power from one of the driving motors.

15. The image forming apparatus according to claim 14, wherein the power transmission unit includes a driving gear formed at another end of the image carrier; and a driven gear formed at another end of the rotating member to engage the driving gear.

16. The image forming apparatus according to claim 15, wherein the power transmission unit includes one or more idle gears connecting the driving gear and the driven gear.

17. The image forming apparatus according to claim 15, wherein the transfer roller engages the driving gear to receive power for rotating.

18. The image forming apparatus according to claim 14, wherein the driving motors include a first driving motor providing the image carrier with power; and a second driving motor providing the developer conveyer with power independently from the first driving motor.

19. The image forming apparatus according to claim 11, wherein the housing receives scattered developer that is moved therein by an air current generated from rotation of the rotating member.

20. The image forming apparatus according to claim 11, wherein the housing has an idle gear for transmitting power from the image carrier to the rotating member.

* * * * *